United States Patent [19]

Kaminkow et al.

[11] Patent Number: 4,968,031

[45] Date of Patent: Nov. 6, 1990

[54] PINBALL MACHINE WITH BALL-LAUNCHING RAMPS

[75] Inventors: Joseph E. Kaminkow, Arlington Heights; Edwin Cebula, West Chicago; John L. Lund, Morton Grove, all of Ill.

[73] Assignee: Data East Pinball, Inc., Melrose Park, Ill.

[21] Appl. No.: 441,605

[22] Filed: Nov. 27, 1989

[51] Int. Cl.[5] ..... A63D 3/02

[52] U.S. Cl. ..... 273/121 A; 273/121 E; 273/119 A; 273/127 C; 273/127 D

[58] Field of Search ..... 273/121 A, 121 E, 118 A, 273/119 A, 127 C, 127 D

[56] References Cited

U.S. PATENT DOCUMENTS

| | | | |
|---|---|---|---|
| 4,354,680 | 10/1982 | Kmiec | 273/121 A |
| 4,606,545 | 8/1986 | Ritchie | 273/121 A |
| 4,773,646 | 9/1988 | Joos, Jr. et al. | 273/121 A |
| 4,840,375 | 6/1989 | Lawlor et al. | 273/121 E |
| 4,861,037 | 8/1989 | Oursler | 273/121 E |

FOREIGN PATENT DOCUMENTS

| | | | |
|---|---|---|---|
| 2124505 | 2/1984 | United Kingdom | 273/121 A |

OTHER PUBLICATIONS

Catalogue p. 67, "Premier Technology" disclosing the layout of the Gottlieb Volcano Pinball Machine.

Instruction Manual by Gottlieb entitled Hollywood Heat, published 4/22/85-XI. Parts Information—p. 48.

*Primary Examiner*—Randall L. Green
*Assistant Examiner*—Gary Jackson
*Attorney, Agent, or Firm*—Gerstman & Ellis, Ltd.

[57] ABSTRACT

A pinball machine having a first ramp on a play field. The first ramp is positioned so that pinballs may be propelled up the ramp to fly through space before landing again on the play field. Preferably, a second ramp is positioned on the play field to receive at least some of the flying balls launched up the first ramp.

13 Claims, 6 Drawing Sheets

PINBALL MACHINE WITH BALL-LAUNCHING RAMPS

BACKGROUND OF THE INVENTION

Pinball machines are popular play devices for places where particularly young people congregate, comprising an inclined play field, plus several targets and other play features arranged on the play field. A rolling ball is used to strike the target, and a score is usually kept by electronic means and displayed in a prominent manner.

As a new play feature to increase the variety of the playing action and to hold the interest of the users, this invention provides apparatus to permit launching of the balls through the air for a short distance. The trajectory of the launched ball varies with the speed of the ball and the like, to provide differing landing points for the ball, with consequent different scoring outcomes and rolling directions being provided to the pinball game.

DESCRIPTION OF THE INVENTION

The pinball machine of this invention defines a play field to receive a rolling ball for pinball play, and means for rolling the ball on the play field. By this invention, a first ramp is provided on the play field, positioned so that the rolling means can launch the ball up the ramp, to fly through space before landing again on the play field. This provides added excitement to the game and a third dimensional characteristic. The trajectory of the flying ball is of course strongly influenced by the ball velocity, so that an added dimension of play may also be provided.

In one preferred embodiment of this invention, a second ramp may be positioned on the play field to receive at least some of the flying balls launched up the first ramp. Thus, if the trajectory of the ball is proper, the flying ball will travel from the first ramp through the air to the second ramp. Otherwise, it may fall short of the second ramp to go to one rolling path, while if it arrives on the second ramp it is directed in another and different rolling path.

The second ramp may define a highest ramp end that faces the first ramp, so that, when the ball lands on the second ramp, it continues its rolling course down the second ramp into an area of the play field that is different from the area that the ball goes if it does not make the jump from the first to the second ramp.

Alternatively, the second ramp may define a series of ramps in a line, positioned generally parallel to the motion of a ball launched up the first ramp. At least a plurality of and typically all of the ramps in the line define, at a lower portion thereof, a ball-receiving aperture. Thus, a ball launched up the first ramp can be caught in one of the ball-receiving apertures depending on the velocity of the launched ball. Then, the pinball machine can score in a manner dependent upon which of the apertures receives the ball.

Means may also be provided for depressing the first ramp to cause it to become a flat part of the play field in a first position, and for raising the first ramp back to ramp configuration in a second position. If desired, a goalpost member (which may include other elevatable target-type devices as well) may be carried adjacent the normal path of the flying balls launched up the first ramp when the first ramp is in the second position. The goalpost member has means for vertically elevating it when the ramp is in the second position, and for vertically retracting it when the ramp is in the first position.

Thus, as signaled by some event on the play field or by a timer, the first ramp may be elevated into ramp configuration while, simultaneously, a small goalpost is raised from a position just in front of the second ramp. Then, a ball being launched by rolling up the first ramp can, if it makes the second ramp, simulate the kicking of a field goal through the goalposts or, alternatively, the flying of a hockey puck, the shooting of a basket, or the like.

The first ramp and goalpost member may be operated by a first arm which is connected adjacent one end to the goalpost member and connected adjacent its other end in pivotal relation with a second arm. The second arm defines an opposed end in sliding contact with the undersurface of the first ramp, which is pivotally connected at one end to the remainder of the play field. A powered rotor is provided, which rotor carries a sliding connector in a slot defined by the first arm. A third arm is pivotally connected adjacent one of its ends to the sliding connector. The third arm is pivotally connected adjacent its other end to the second arm between the connection of the first and second arm, and the second arm opposed end. As a result of this, selective rotation of the rotor, which may be powered by an electric motor, moves the first ramp between the first and second positions, and simultaneously retracts and elevates the goalpost member in correlation with the positions of the first ramp.

Ball target means may be positioned under the second ramp. Thus, when the first ramp is in its first, retracted position which is flush against the rest of the play field, the ball target means under the second ramp may be exposed to rolling balls.

Thus, the same area of the play field can exhibit two separate configurations for alternate play.

DESCRIPTION OF SPECIFIC EMBODIMENTS

Figure 1:
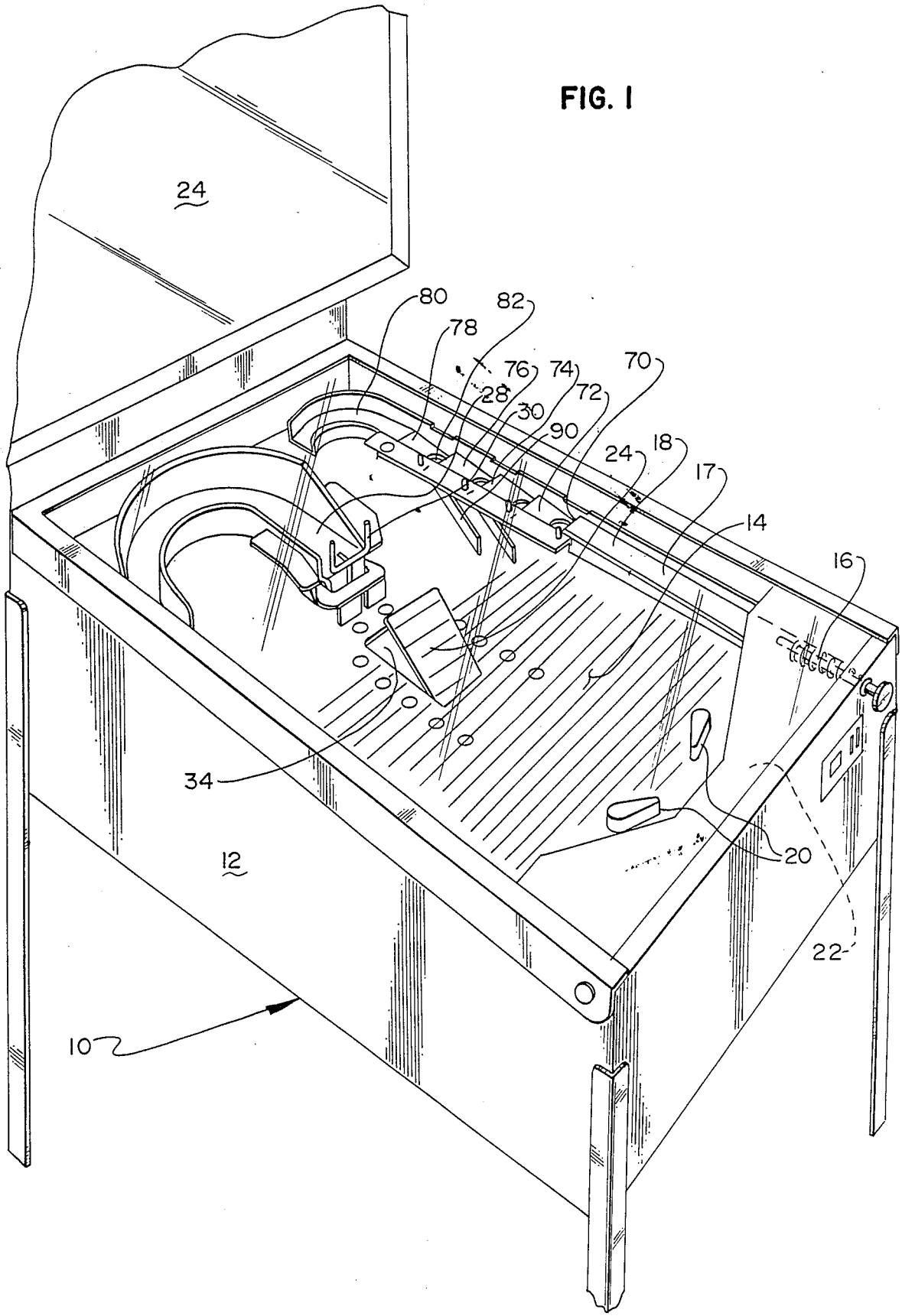
FIG. 1 is a perspective view of a pinball machine in accordance with this invention.

Referring to the drawings, FIGS. 1 through 8 show a first embodiment of a pinball machine 10, which comprises a frame 12 which supports a play field 14 having a ball launching plunger 16 for launching metal pinballs along ball launching chute 17, ending in ramp 18, on the play field. Additionally, conventional pinball flippers 20 are provided to permit the user to oppose the natural tendency of pinballs to roll down the inclined play field 14 to the ball storage slot 22, from where they can be recycled back to ball plunger 16. A typical pinball display board 24 may also be provided, as is conventional.

Figure 2:
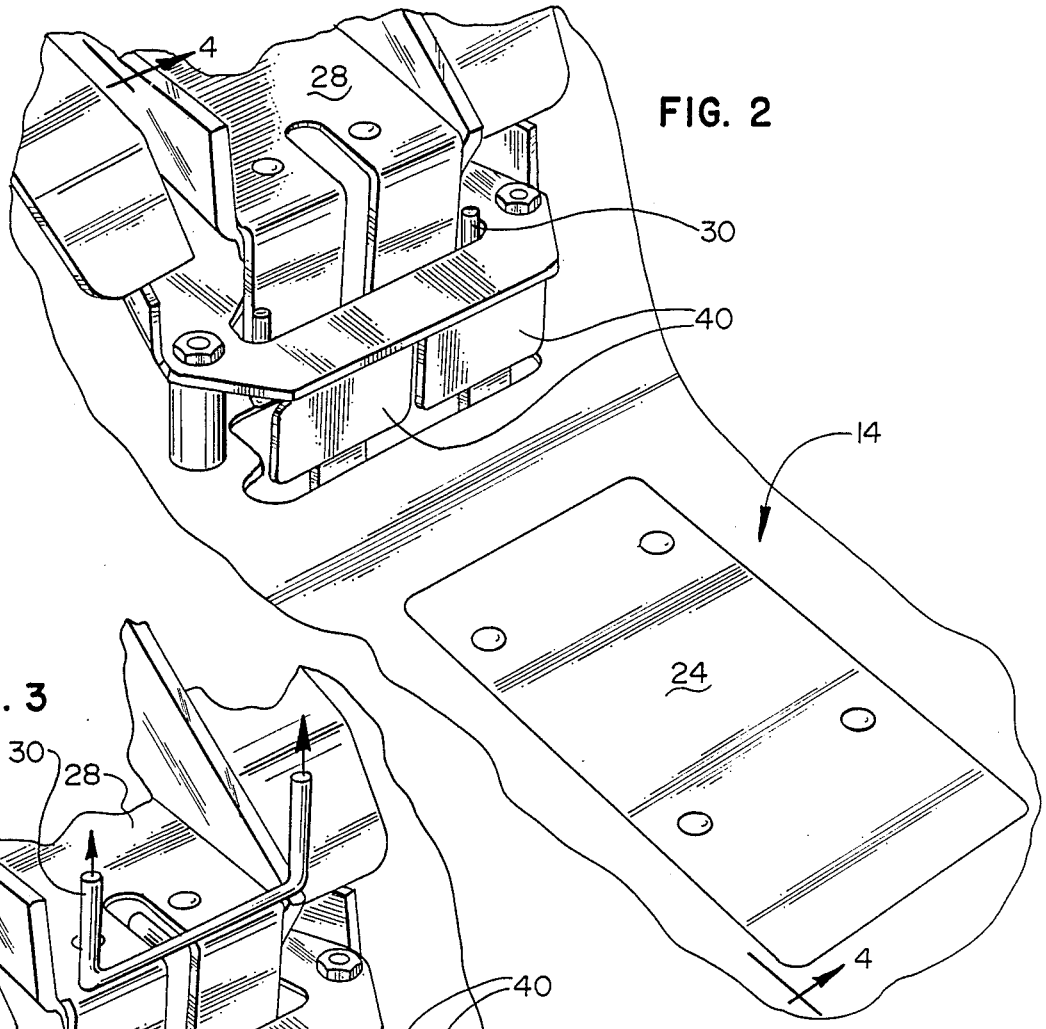
FIG. 2 is a fragmentary, enlarged perspective view of a portion of the playing field of the pinball machine of FIG. 1 showing the first ramp in its first, retracted position in which it is flush with the remainder of the play field.
Figure 3:
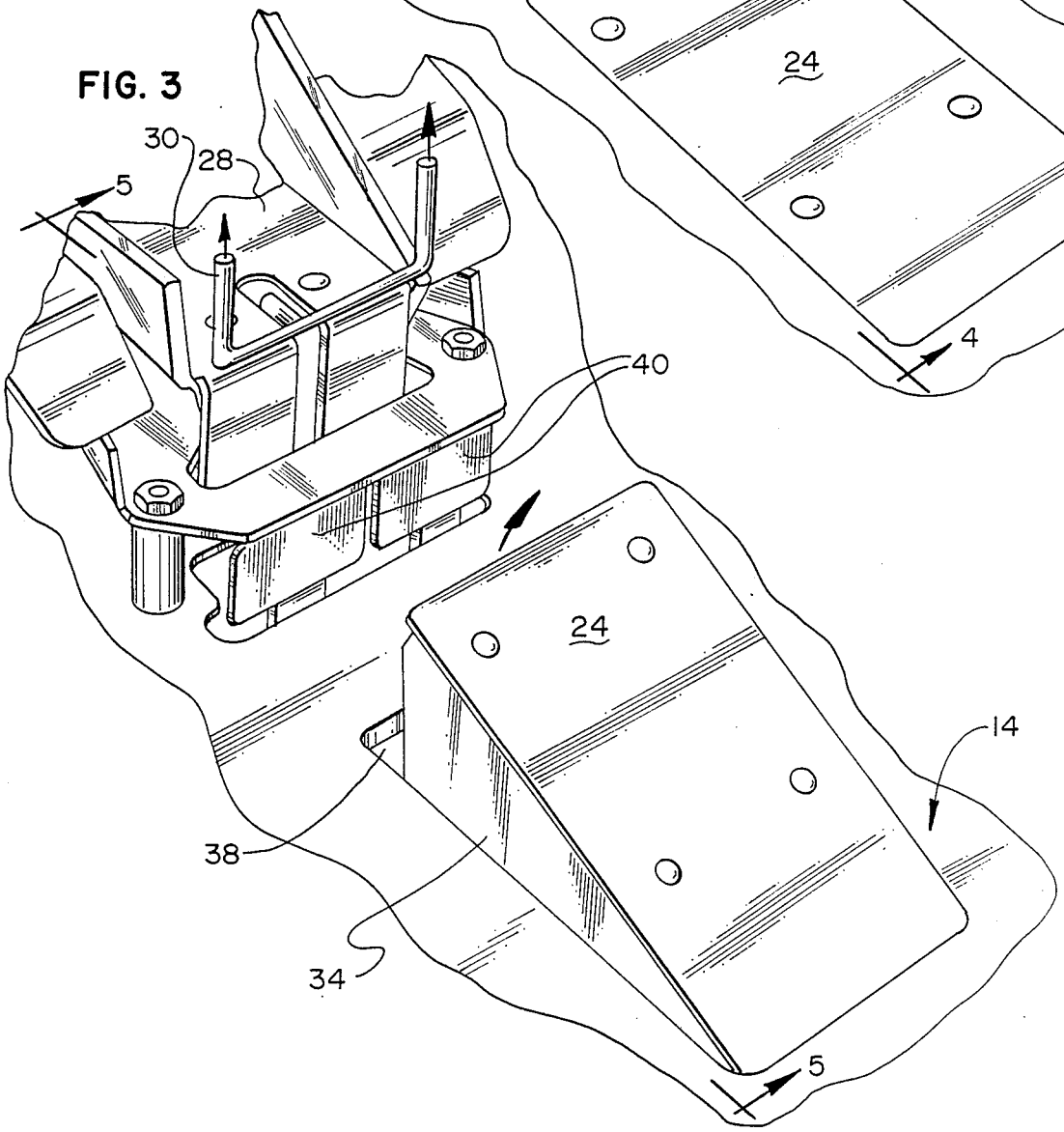
FIG. 3 is a fragmentary, perspective view similar to FIG. 2, but showing the first ramp in its second position in which it forms a ramp configuration.

Referring particularly to FIGS. 1 through 3, a raisable and depressible first ramp 24 is provided in play field 14. Rotatable flippers 20 may be used to propel a ball that is falling toward receptacle 22 back up the slanted play field 14 and, with skill or luck, such a ball can roll up the elevated ramp 24 to be launched into the air. See in FIG. 5 such a ball as it is launched from ramp 24, passing in a trajectory through the air in a path defined by ball positions 26a-26b, to land on a second ramp 28. In the process, ball 26 can pass through the elevatable and retractable goalpost 30, if fortune is with the pinball game player. Alternatively, ball 26 can fall short of second ramp 28, striking wall 32 and falling again to the main portion of play field 14, for further play.

Elevatable ramp 24 carries a peripheral shroud 34 to prevent balls from entering under ramp 24 in this particular embodiment. Buffer member 36 may be provided to keep balls 26 from lodging in the aperture 38 in which ramp 24 resides.

Figure 5:
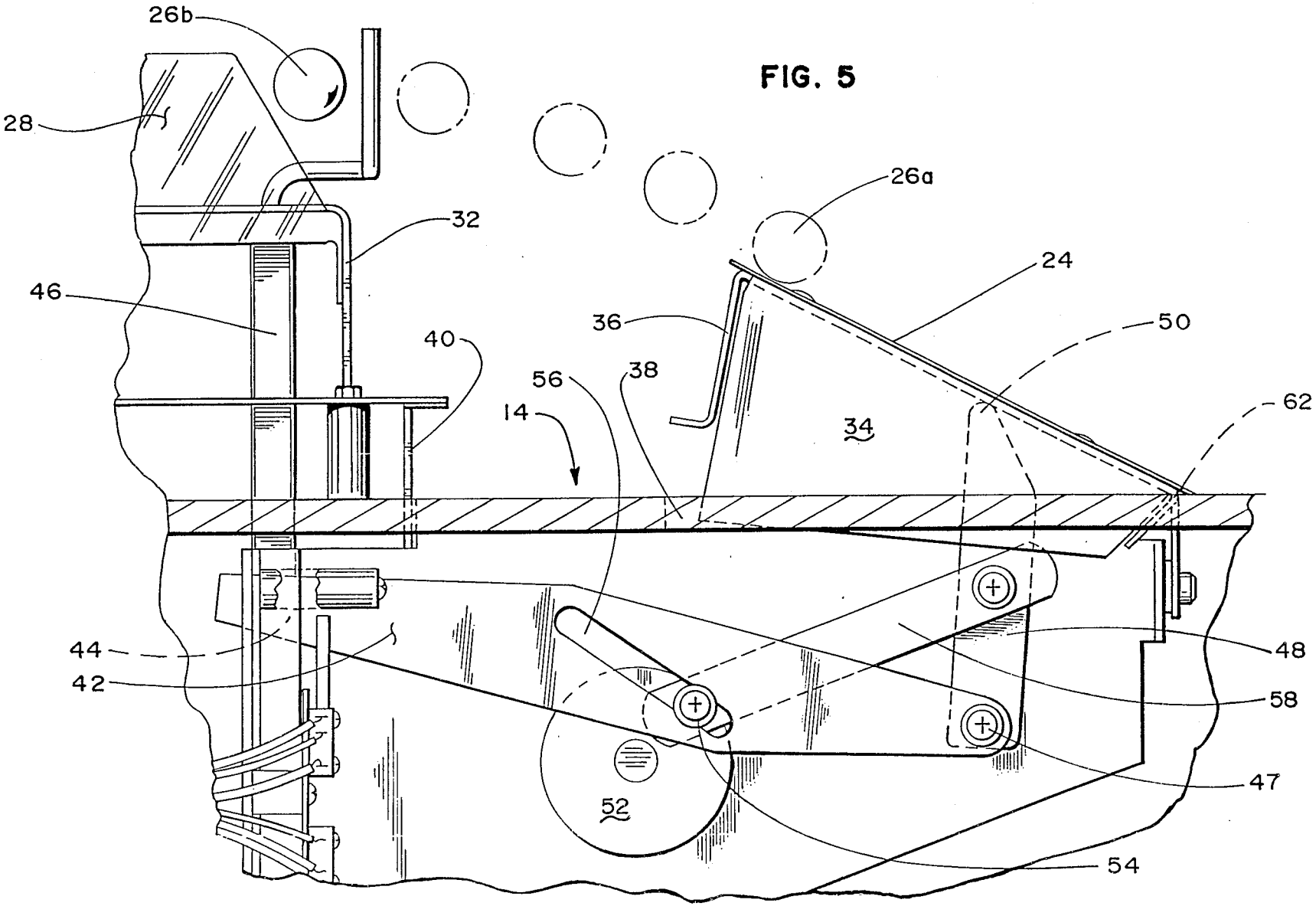
FIG. 5 is a sectional view taken along line 5—5 of FIG. 3.

FIGS. 1, 3, and 5 show the pinball game of this invention in one playing configuration, which configuration may be dictated by any desired means including a timer, or by the striking of a selected target by a pinball for play in the elevated ramp mode.

Figure 4:
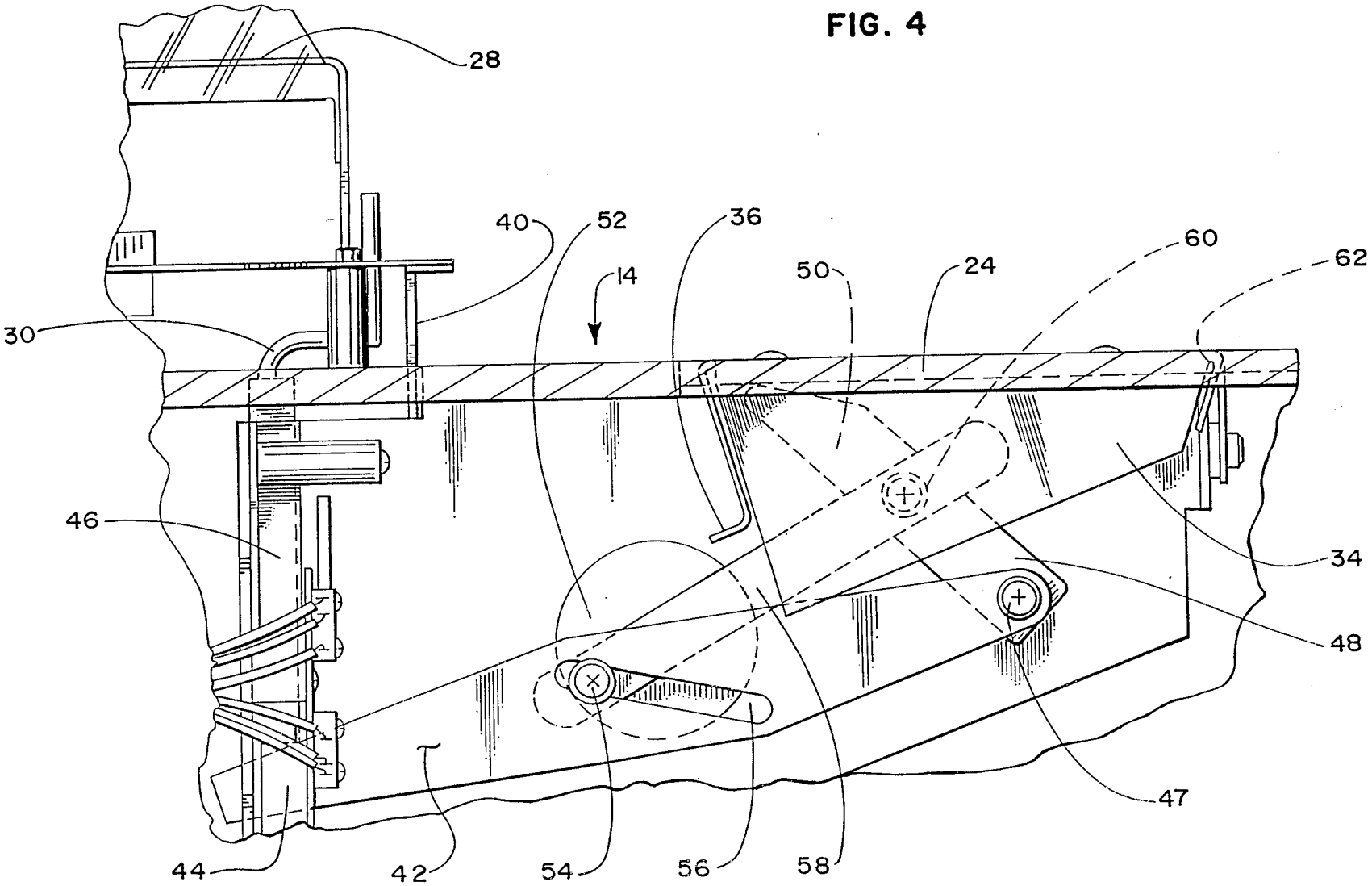
FIG. 4 is a sectional view taken along line 4—4 of FIG. 2.

Alternatively, as shown by FIGS. 2 and 4, the pinball machine of this invention has another playing mode in which first ramp 24 is depressed to become a flat part of play field 14. Simultaneously, goalpost 30 is, in this embodiment, taken down into a depressed position. In this configuration, target members 40, positioned under ramp 28, become exposed as targets for the pinballs which are fired by rotating flippers 20 (FIG. 1).

Typically, the pinball game may initiate its operation in the configuration shown in FIGS. 2 and 4. Then, when one or both of targets 40 are struck by a pinball, impelled by flippers 20, the apparatus can go into its elevated ramp mode as disclosed in FIGS. 1, 3 and 5, to permit the launching of pinballs at the target which includes goalpost 30 and second ramp 28. Second ramp 28 may then convey the pinball to another portion of the play field for further play action as may be desired.

FIG. 4 shows the apparatus which is used to elevate and retract ramp 24 on play field 14. A first arm 42 has one end 44 that is positioned under an elevatable base 46 which carries goalpost member 30. The other end 47 of first arm 42 is attached in pivotal relation with a second arm 48. Second arm 48 defines an end opposed to the connection with first arm 42, which opposed end 50 is in sliding contact with the underside of first ramp 24.

Powered rotor 52, which may be connected to an electric motor or the like, carries a sliding connector 54 in a slot 56 defined by first arm 42. Also, sliding connector 54 is in pivotally attached relation to a third arm 58 at one end thereof, with the third arm being pivotally connected adjacent its other end 60 to second arm 48 at a location intermediate the connection of end 46 and opposed end 50.

Thus, upon rotation of rotor 52 by about 160° or so, ramp 24 and goalpost member 30 move from their depressed configuration as shown in FIG. 4 to their elevated position as shown in FIG. 5, with rotor 52 moving clockwise. End 44 of first arm 42 is forced upwardly, driving base 46 and goalpost member 30 upwardly. At the same time, end 47 of first arm 42 is moved downwardly, while third arm 58 is generally driven to the right, as shown, to force second arm 48 to pivot to the right so that end 50 slides along the underside of ramp 24 and forces it upwardly, about pivot point 62. In this elevated mode, as previously described, balls 26 may be launched through the air along ramp 24 toward second ramp 28 and goalpost 30.

For retraction of ramp 24 back to the first position of FIG. 4, rotor 52 rotates counterclockwise back to its original position, with ramp 24 falling, typically by its own weight, back to the desired position.

Figure 6:
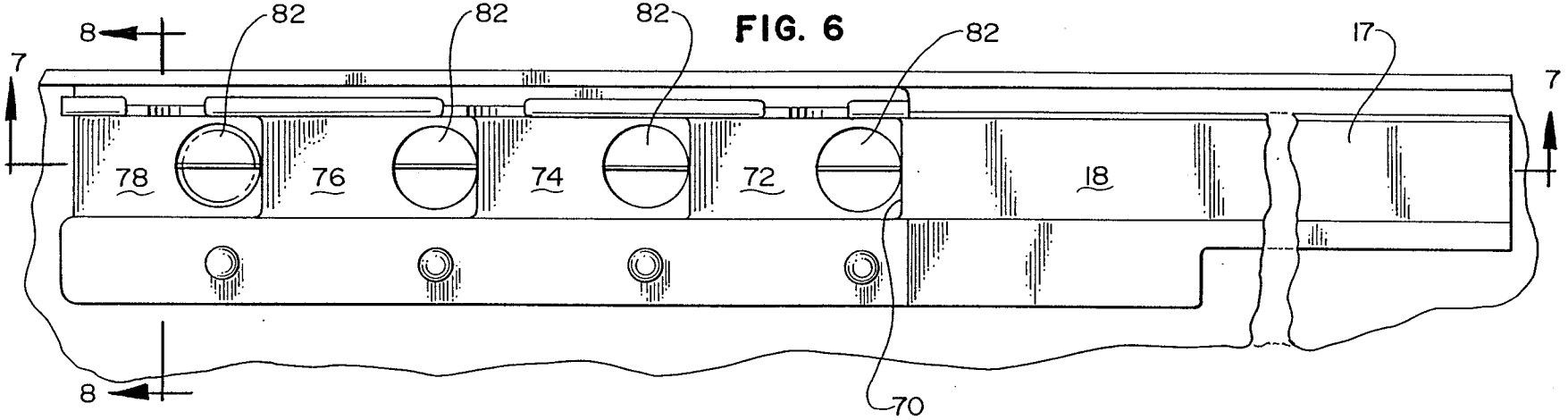
FIG. 6 is a fragmentary, plan view taken along the initial ball launching chute of the play field of the pinball machine of FIG. 1.
Figure 8:
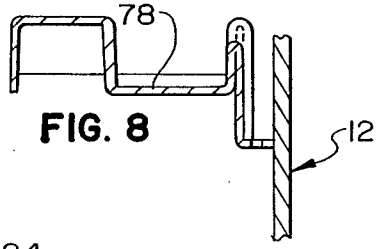
FIG. 8 is a sectional view taken along line 8-8 of FIG. 6.
Figure 7:
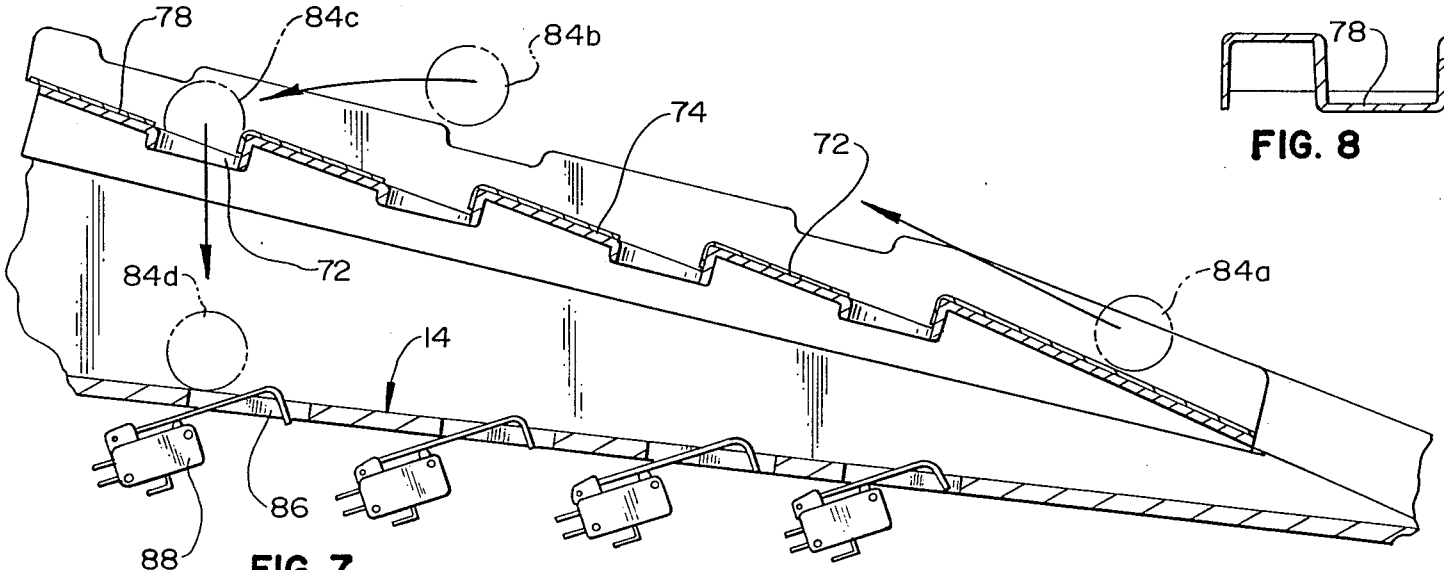
FIG. 7 is a sectional view taken along line 7—7 of FIG. 6.

Turning to FIGS. 6 through 8, a detail of the pinball machine of FIG. 1 is shown in which another embodiment 18 of a first ramp in accordance with this invention is shown. Ramp 18 is part of the launching chute 17 for balls which are propelled by spring plunger 16.

As the ball is shot through chute 17, it is elevated slightly by its traverse of ramp 18, being launched off of upper edge 70 of the ramp. Depending upon the velocity of the ball imparted by spring plunger 16, ball sails through the air for a variable distance, as defiend by ball positions **84*a*–84*c* (FIG. 7), to land on one of second ramps 72, 74, 76, 78, or alternatively, beyond the respective four ramps 72–78 in chute 80, to be deposited at an upper end of play field 14. If a ball lands on one of the second ramps 72–78, it may careen off the respective upper edge of the ramps onto the next until its velocity is slowed enough to be captured by the upward slope of one of the ramps. If this happens, the ball 84 will roll backwards to fall through a ball receiving aperture 82**.

As specifically shown in FIG. 7, ball 84 is launched and flies through the air in a trajectory **84*a*–84*b*–84*c*, to be captured by the last of the second ramps, ramp 78. Then, ball 84 falls through aperture 72 of ramp 76 to land upon the play field 14 and to be deposited in aperture 86 in position 84*d*, in which there resides a switch 88 which is sensitive to the presence of ball 84. The passage of the ball through aperture 72 of ramp 76** is thus electrically recorded for scoring.

Then, ball **84*d* may be popped out of aperture 86, or it may simply roll around if the aperture is not large enough to receive the ball, to be directed again out onto the play field. For example, chute 90 (FIG. 1) may be used to direct balls captured by ramp 78outwardly into a lower central portion of the play field for further play with flippers 20. The balls captured by the other of ramps 72, 74 or 76** may roll downwardly in different paths.

Figure 9:
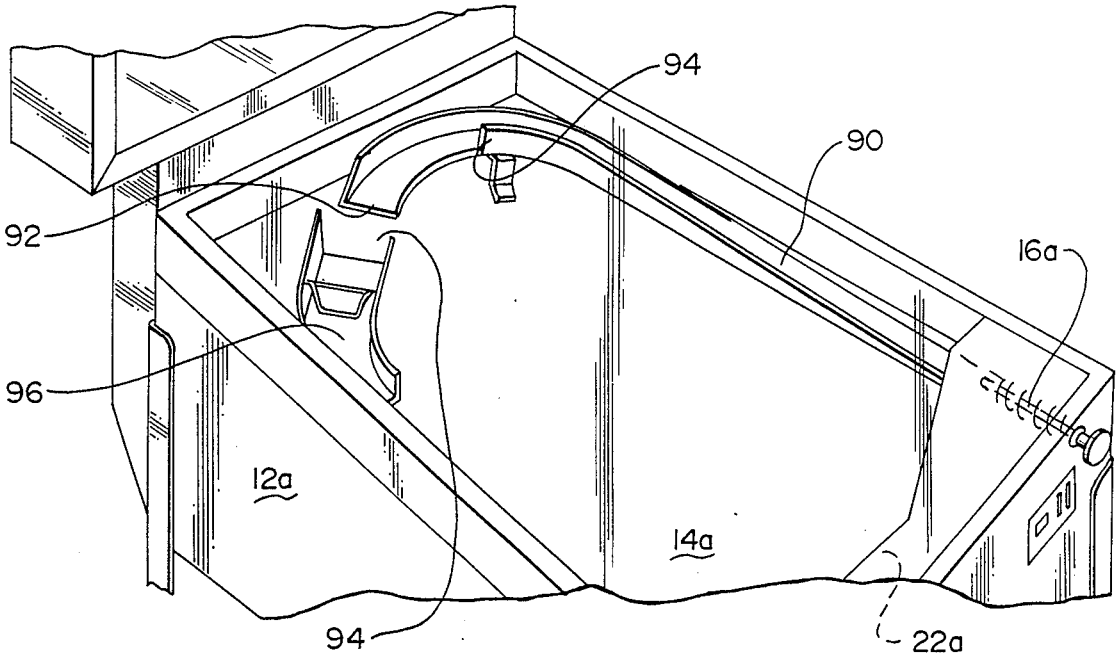
FIG. 9 is a simplified, perspective view of another embodiment of pinball machine in accordance with this invention.
Figure 10:
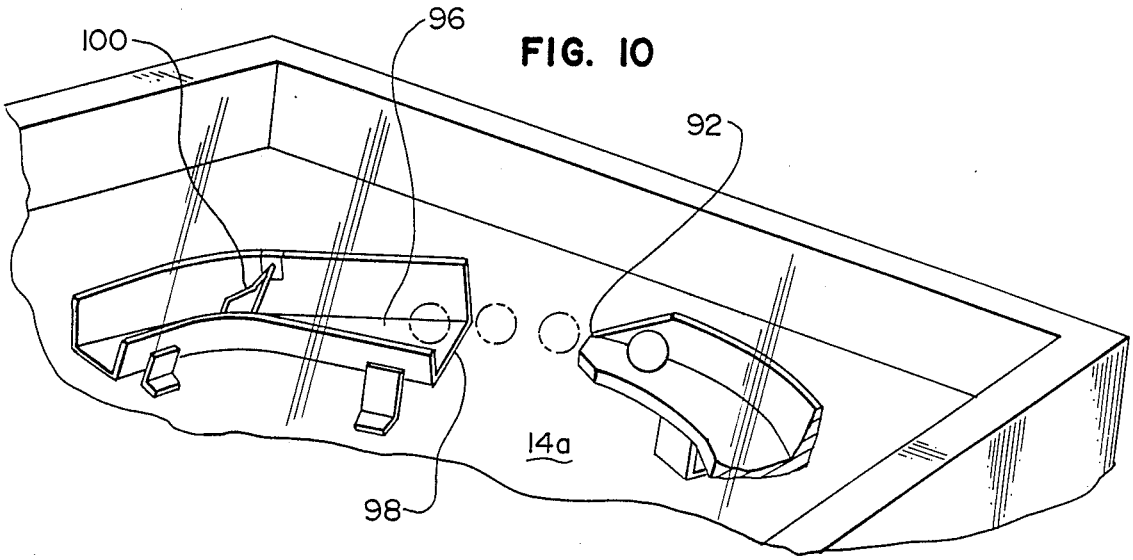
FIG. 10 is a fragmentary, enlarged perspective view, from another angle, of the apparatus of FIG. 9.

FIG. 8 shows a cross section of the structure of ramp 78, which may be a shaped piece of metal integral with the remaining ramps 72, 74, 76 which are attached to the frame 12 of the pinball machine FIGS. 9 and 10 show another embodiment of a pinball machine useable in this invention. Frame **12*a* may be similar in structure to frame 12 of the previous embodiment, as may play field 14*a***. In both this and the previous embodiment, many conventional targets and other features of the pinball machine have been not shown for purposes of clarity, but it is generally contemplated that the pinball machine carries large numbers of various targets and features all over the play field.

In this embodiment, balls may be launched along chute 90 by plunger 16*a*, with chute 90 turning into a first launching ramp 92. It can be seen that chute 90 has side walls, but the inner side wall 94 terminates short of the end of ramp 92, and the upper end of chute 90, beyond the end of wall 94, is canted downwardly so that slow moving balls will drop from ramp 92 onto sloped playing field 14*a*, to roll toward ball collection area 22*a*. If, however, a ball has sufficient velocity, it will jump gap 94 from the end 92 of the first ramp, as shown in FIG. 10, to be received by second ramp 96, which slopes downwardly from its upper edge 98. Swinging gate 100 may be provided, which may be connected to an electrical switch for scoring purposes.

Then, the balls that make it to the second ramp 96 are conveyed by a chute structure to a different part of the play field for further play.

Thus, by this invention, improvements to pinball machines are provided, with the exciting feature of a means for launching pinballs through the air, for a variable outcome of ball travel and increased versatility and play interest in a pinball machine.

The above has been offered for illustrative purposes only, and is not intended to limit the scope of the invention of this application, which is as defined in the claims below.

That which is claimed is:

1. In a pinball machine which defines a play field to receive a rolling ball for pinball play, and means for rolling the ball on the play field, the improvement comprising, in combination:

a first ramp on said play field, said ramp defining a lower, ball-receiving end and an upper, ball-launching end, said upper end terminating in an abrupt drop-off, said ramp being positioned whereby said rolling means can launch said ball up the ramp to cause said ball to roll off the upper end and fly through space before landing again on the play field, and a second ramp positioned on the playfield to receive at least some of the flying balls launched up the first ramp.

2. The pinball machine of claim 1 in which said second ramp defines a series of ramps in a line generally parallel to the motion of a ball launched up the first ramp, at least a plurality of said second ramps in a line defining, at a lower portion thereof, a ball-receiving aperture whereby a ball launched up said first ramp can be caught in one of said ball-receiving apertures depending on the velocity of the launched ball.

3. The pinball machine of claim 1 in which the second ramp defines a highest ramp end that faces said first ramp.

4. In a pinball machine which defines a play field to receive a rolling ball for pinball play, and means for rolling the ball on the play field, the improvement comprising, in combination:

a first ramp on said play field, positioned whereby said rolling means can launch said ball up the ramp to fly through space before landing on the play field and, means for depressing said first ramp to cause it to become a flat part of the play field in a first position, and for raising said first ramp back to ramp configuration in a second position.

5. The pinball machine of claim 4 in which a goalpost member is carried adjacent the normal path of the flying balls launched up the first ramp in the second position, said goalpost member having means for vertically elevating as the ramp moves to the second position and for vertically retracting as the ramp moves to the first position.

6. The pinball machine of claim 5 in which a first arm is in contact adjacent one end thereof to said goalpost member, and adjacent its other end in pivotal relation with a second arm which defines an opposed end in sliding contact with the undersurface of the first ramp; a powered rotor which carries a sliding connector in a slot defined by the first arm; a third arm pivotally connected adjacent one end to said sliding connector, said third arm being pivotally connected adjacent its other end to said second arm at a point between the first and second arm connection and the second arm opposed end, whereby selective rotation of the rotor moves the first ramp between said first and second positions and simultaneously retracts and elevates the goalpost member.

7. The pinball machine of Claim 6 in which a second ramp is positioned on the play field to receive at least some of the flying balls launched up the first ramp, and ball target means positioned under the second ramp, to be exposed to rolling balls when the first ramp is in the first position.

8. In a pinball machine which defines a play field to receive a rolling ball for pinball play, and rolling means for rolling the ball on the play field, the improvement comprising, in combination:

a first ramp on the play field positioned whereby the rolling means can launch the ball up the ramp to fly through space before landing again on the play field;

means for depressing the first ramp to cause it to become a flat part of the play field in a first position, and for raising the first ramp back to ramp configuration in a second position;

a second ramp positioned on the play field to receive at least some of the flying balls launched up the first ramp; and ball target means positioned under the second ramp to be exposed to rolling balls when the first ramp is in the first position.

9. The pinball machine of claim 8 in which a goalpost member is carried adjacent the normal path of the flying balls launched up the first ramp in the second position, said goalpost member having means for vertically elevating as the ramp moves to the second position and for vertically retracting as the ramp moves to the first position.

10. The pinball machine of claim 8 in which a first arm is in contact adjacent one end to said goalpost member and adjacent its other end in pivotal relation with a second arm which defines an opposed end in sliding contact with the undersurface of the first ramp; a powered rotor which carries a sliding connector in a slot defined by the first arm; a third arm pivotally connected adjacent one end to said sliding connector, said third arm being pivotally connected adjacent its other end to said second arm between the first and second arm connection and the second arm opposed end, whereby selective rotation of the rotor moves the first ramp between said first and second positions and simultaneously retracts and elevates the goalpost member.

11. In a pinball machine which defines a play field to receive a rolling ball for pinball play, and means for rolling the ball on the play field, the improvement comprising, in combination:

a first ramp on the play field positioned whereby said rolling means can launch said ball up the ramp to fly through space before landing again on the play field; and a series of second ramps positioned in a line generally parallel to the motion of a ball launched up the first ramp, at least a plurality of the second ramps in a line defining, at a lower portion thereof, a ball-receiving aperture, whereby a ball launched up said first ramp can be caught in one of said ball receiving apertures depending on the velocity of the launched ball.

12. The pinball machine of claim 11 said second ramps defining highest ramp ends that face away from said first ramp.

13. The pinball machine of claim 12, in which an added ball chute is provided beyond said second ramps to receive overshooting balls.

* * * * *